United States Patent [19]

Scheidweiler

[11] 4,168,497

[45] Sep. 18, 1979

[54] FIRE AND SMOKE SENSING SYSTEM

[75] Inventor: Andreas Scheidweiler, Stäfa-Uerikon, Switzerland

[73] Assignee: Cerberus AG, Mannedorf, Switzerland

[21] Appl. No.: 870,752

[22] Filed: Jan. 19, 1978

Related U.S. Application Data

[63] Continuation-in-part of Ser. No. 666,644, Mar. 15, 1976, abandoned.

[51] Int. Cl.[2] ..... G08B 17/10

[52] U.S. Cl. ..... 340/629; 340/517

[58] Field of Search ..... 340/628, 629, 630, 517, 340/522; 250/381, 382, 384, 385

[56] References Cited

U.S. PATENT DOCUMENTS

| | | | |
|---|---|---|---|
| 2,994,768 | 8/1961 | Derfler | 340/629 |
| 3,530,450 | 9/1970 | Walthard et al. | 340/629 X |
| 3,611,335 | 10/1971 | Ogden et al. | 340/522 |
| 3,728,706 | 4/1973 | Tipton et al. | 340/629 X |

*Primary Examiner*—John W. Caldwell, Sr.
*Assistant Examiner*—Daniel Myer
*Attorney, Agent, or Firm*—Flynn & Frishauf

[57] ABSTRACT

At least two sensors are used, providing electrical output signals to indicate alarm conditions, one of the sensors being a bipolar ion sensor having a shielded ion chamber formed to slow or brake atmospheric currents therethrough, and a second sensor which operates essentially in unipolar mode having an ion chamber freely accessible to atmospheric flow therethrough.

6 Claims, 5 Drawing Figures

FIRE AND SMOKE SENSING SYSTEM

This is a continuation-in-part of application Ser. No. 666,644, filed Mar. 15, 1976, now abandoned.

CROSS REFERENCE TO RELATED PATENTS AND APPLICATION

U.S. Pat. Nos. 2,994,768, Derfler; 2,963,600, Meili et al.; 3,233,100; 3,559,196, Scheidweiler; 3,710,110, Lampart et al.; 3,909,813, Scheidweiler et al.; and U.S. patent application Ser. No. 666,645, filed Mar. 16, 1976, Scheidweiler, now U.S. Pat. No. 4,058,803, all assigned to the assignee of the present application.

The present invention relates to a fire or smoke sensing alarm system in which two different types of fire or smoke sensors are used, jointly controlling an alarm circuit to provide an alarm signal when at least one of the sensors responds.

Fire sensing systems require rapid detection and response of various types of fires which may arise. The various types of fires will have different resultant characteristics, that is, result in different consequential combustion products, and in different transport speeds of these combustion products.

Ionization-type fire sensors are very suitable; decrease of ion current through such sensors is utilized to provide an alarm. Such sensors permit response not only when visible smoke is detected; these sensors respond already to fire aerosols which occur in the initial stages of a fire. It has been found that the ion current in such sensors is dependent not only on the presence of smoke or fire aerosols, but is additionally affected by air or atmospheric currents arising in the sensor. If the air is not still, but is subject to disturbances, winds, drafts, or the like, ion-type fire sensors tend either to give false alarms or to decrease their sensitivity. It is therefore necessary to so arrange ionization-type fire sensors that the atmosphere therein is essentially still, that is, has none or only very slight movement. Air currents within the sensor should be avoided. This can be obtained by using shields, baffles or shrouds which shield drafts and currents, to suitably shape the wall defining the ionization chamber and the like. The wall may be constructed, for example, as a double-wall unit having offset openings requiring any air flow to follow a sinuous or tortuous path. Air or atmosphere flowing into the sensor thus is deflected. The electrodes or other constructional elements of the sensor also may be shaped to achieve this result. While atmospheric currents within the sensor are avoided, the penetration of contaminated air into the interior of the chamber is likewise impeded, and thus the response speed is decreased, that is, the time after occurrence of a fire when the sensor will respond is delayed. Smouldering fires cause little atmospheric movement; thus, ionization-type fire sensors which are protected against atmospheric currents exhibit a poor response time with respect to such fires.

Optical smoke and fire detectors are not subject to disturbances due to atmospheric or air currents; they are essentially immune against drafts, winds, and air flow. They are not capable, however, of responding to smoke or fire aerosols which are not visible, that is, which do not attenuate or scatter light. They are only capable of responding when there is visible smoke. In the early stages of a fire, however, the essentially invisible, transparent fire aerosols are the only ones which will arise to indicate an incipient fire. The smoke detectors of smaller size, which are preferred in their use, provide the best reaction only to white or light-colored smoke since they operate on the basis of dispersion of a light beam; they hardly react to black smoke which results only in extinction of light transmission, rather than causing light dispersion. Light transmission-type smoke detectors which respond upon presence of either type of smoke, white smoke or black smoke, are usually too large to permit their practical installation. Decreasing the light path by use of deflection mirrors results in a tendency to give false alarms due to deposits of dirt, dust and other contamination on the reflectors.

It has previously been proposed to combine ionization-type fire sensors and dispersion-type smoke detectors into a single unit in order to increase the reliability of response of the sensors. Such a system of double protection still is not sufficiently sensitive, however, to smouldering fires in which either light attenuating smoke, or smoke not having any light dispersion characteristics, with only slight atmospheric movement, is generated.

It is an object of the present invention to provide a fire sensing system which provides a more reliable indication of the presence of various types of fires, particularly smouldering fires as well as high-flaming fires, and which reacts rapidly and reliably to most types of fires arising in actual practice, without being subject to false alarms.

SUBJECT MATTER OF THE PRESENT INVENTION

Briefly, two ionization-type sensors are combined, the sensors being constructed differently, however, and having different response characteristics; one of the sensors includes a bipolar ionization chamber in which atmospheric currents are suppressed, or slowed, so that there is little air circulation therein; the other sensor has a unipolar ionization chamber which has essentially unimpeded access to air, and permits air flow and air currents therethrough.

The present invention is based on the discovery that the characteristics of the ionization chamber depend on the type and arrangement of the ionization in the space between the electrodes of the ionization chamber.

The invention will be described by way of example with reference to the accompanying drawings, wherein.

Figure 1:
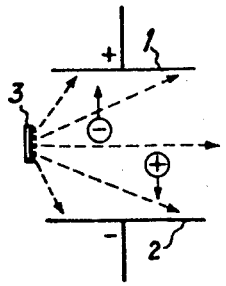
Fig. 1 PRIOR ART
FIG. 1 is a highly schematic cross-sectional diagram of the space between the electrodes of a bipolar ionization chamber.

The space between electrodes 1, 2 (FIG. 1) is ionized by a radioactive substance 3. Ionization is relatively uniform in the space. Thus, ions of both polarities are generated at all random positions within the space. Upon application of a voltage to the electrodes 1, 2 as shown, a bipolar ion current will flow. The positive and negative ions will move in opposite directions, attracted by the electrodes of a polarity opposite to that of the ions. Upon penetration of smoke or fire aerosols into the space between the electrodes, the ions will attach themselves to the particles. Ion current will thus decrease, resulting, effectively, in an increase in reflected resistance between the electrodes. A similar effect is, however, caused by air currents, since movement of air in the ionization chamber will sweep a portion of the ions out of the chamber so that they can no longer reach the electrodes, causing a decrease in ion currents and hence again an increase in reflected resistance. Air circulation in the space between the electrodes thus likewise decreases the ion current; in extreme cases, a false alarm will be generated since the current may have decreased to an extent which would be caused by the presence of smoke or fire aerosols. To prevent false alarms, that is, decrease of current without presence of a fire, air currents are prevented from occurring between the electrodes. Atmospheric currents and atmospheric flow are slowed, for example by shielding the space between the electrodes as schematically shown by baffle b. Penetration of air into the ionization chamber is thus slowed or braked. Various solutions have been proposed to achieve this result. While the sensitivity of the chamber is maintained, initiation of an alarm can be delayed in some cases if there is but little atmospheric circulation. An ionization chamber of this type in a fire alarm system, is described in cross-referenced U.S. Pat. No. 2,909,813, Scheidweiler et al.

Figure 2:
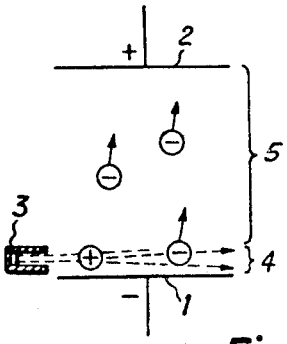
Fig. 2 PRIOR ART
FIG. 2 is a highly schematic cross-sectional diagram of the space between the electrodes of a unipolar ionization chamber.
Figure 3:
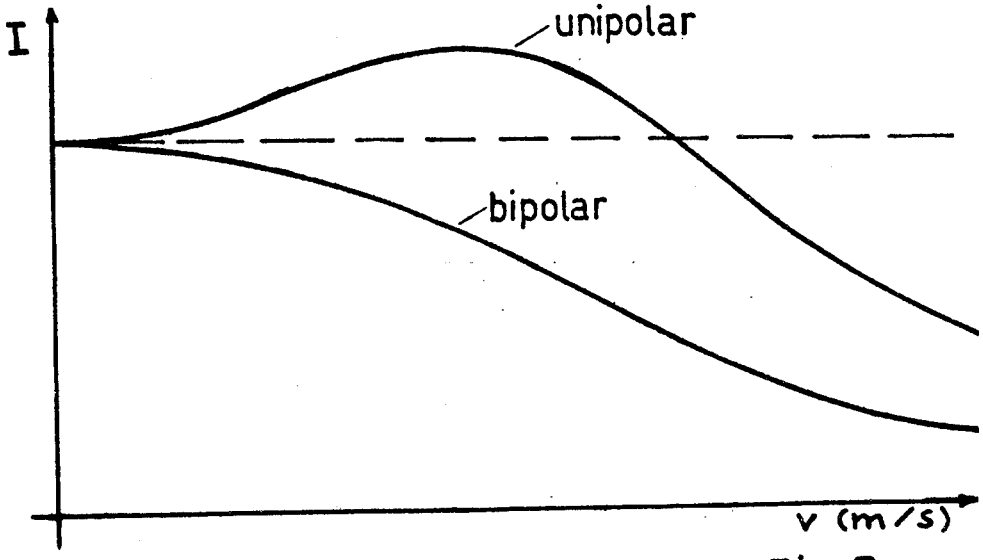
FIG. 3 is a graph of air velocity (abscissa) in meters per second versus current flow I (ordinate) of an ionization chamber.

A different type of ionization chamber is illustrated in FIG. 2, in which the radioactive source 3 is so shielded that only a small portion 4 of the overall space between the electrodes 1, 2 is ionized. The space 4 will have ions of both polarities occur therein. Due to the voltage across the electrodes 1, 2, ions of only one polarity will be drawn out of this space. This region 5, which is essentially the major portion of the space between the electrodes, will have a unipolar ion current flow therein. As a result, a space charge will develop in the space 5. This difference substantially changes the response characteristics of the unipolar ionization chamber with respect to the bipolar chamber of FIG. 1. It has been found that an essentially unipolar ionization chamber has a high sensitivity for heavy particles, such as smoke or fire aerosols, already at low voltages or currents, and that its sensitivity with respect to air currents is less. Previously used unipolar ionization chambers had such a large portion thereof operating on the bipolar principle that it was not recognized that a preponderance of the unipolar region resulted in an exactly opposite response with respect to atmospheric currents than that of a bipolar ionization chamber. This is particularly apparent from FIG. 3 in which it is seen that the ion current in a bipolar ionization chamber decreases approximately uniformly with air speed therethrough, whereas in a unipolar ionization chamber there is first a rise in current. It has been found that this rise will occur so long as the unipolar effect, i.e., the space charge between the electrodes has been maintained. Due to turbulence, the unipolar range is removed as the atmospheric speed increases and the chamber will then have a characteristic similar to that of the bipolar ionization chamber, that is, the ion current will drop with increasing air speed therethrough.

Upon presence of air currents, the characteristic response of an ionization smoke or fire detector with a predominantly unipolar ionization chamber (FIG. 2) results in increase in ionization current (FIG. 3) resulting in a decrease in sensitivity, initially to a predetermined limit. It is thus not necessary to utilize windshields, current braking shrouds and baffles and the like; a unipolar ionization sensor can thus be an essentially open chamber with free access to the surrounding atmosphere without triggering a false alarm due to drafts without fire. It is only necessary, for practical reasons, to provide sufficient structural elements to support the components of the sensor and to prevent penetration of foreign bodies, for example insects or the like. A thin wire mesh or screen schematically shown at W in front of the ionization chamber is all that is necessary, arranged so that passage through and penetration of air are hardly prevented. Under normal conditions, therefore, there is no risk of a false alarm as may be the case, for example, in bipolar ionization fire sensors. An ionization chamber of this type in a fire alarm system is described in cross referenced U.S. Pat. No. 2,994,768, Derfler.

Figure 4:
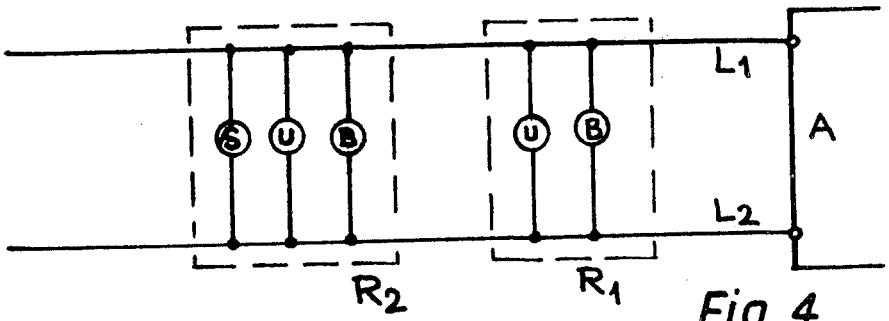
FIG. 4 is a schematic diagram of the connection of the system.

The system uses the best features of both sensors, as seen in FIG. 4 and combines the features to provide (a) fast, reliable response and (b) rejection of conditions leading to false alarms. A central alarm unit A located, for example, at a central point or in the space to be supervised, is connected over common connecting lines L1, L2 which lead to supervised areas, for example rooms R1, R2. Each one of the lines L1, L2 has an ionization sensor B with a bipolar ionization chamber and a further ionization sensor U with a predominantly unipolar ionization chamber connected thereto. Both chambers B and U are located in the same room to be supervised, that is, in rooms R1, R2. The bipolar ionization chamber B is associated with means to slow access of atmosphere thereto; the unipolar ionization chamber U has essentially free access to ambient atmosphere. The lines L1, L2 can extend through various other rooms R2 . . . Rn, each of which include an additional bipolar ionization sensor B and a unipolar ionization sensor U. Other types of sensors, schematically indicated as sensor S, may also be connected to the lines L1, L2; such other sensors may, for example, be optical sensors operating on light dispersion principle; flame indicators, and the like, which additionally increases the sensitivity of the system.

Combination of a shielded bipolar sensor and an open, unshielded unipolar sensor results in more rapid response to practically all types of usually occurring fires than previously known systems. An open fire with generation of smoke and noticeable atmospheric currents causes relatively rapid penetration of smoke into the bipolar chamber B, which will provide an alarm already in the initial stages of the fire, during which the aerosol density is high, although the density of the smoke itself may still be low. On the other hand, smouldering fires with low air circulation will be sensed by the open unipolar ionization chamber U. Connecting other types of fire or smoke sensors in parallel thereto, for example, flame-responsive sensors which react particularly rapidly with respect to fires caused by fluids without generation of smoke—such as fires caused by alcohol or hydrocarbons, may also be used, particularly if such fires can be expected due to the nature of utilization of the space being supervised. The sensor S may also be sensitive to certain gases such as carbon monoxide, halogens or halogenides occurring in a fire; other types of fire sensors and detectors may be used.

The unipolar ion current may be generated in various ways. The radioactive layer, for example, may be applied to one of the electrodes and so arranged that it has a radiation range which is substantially less than the distance between the electrodes. The range of the unipolar region in the ionization chamber can be influenced by the selection of the radiation range of the radioactive material, and thus the relative change of the ion current vs. air currents can be controlled. The unipolar and the bipolar ranges can also be so matched to each other that the ionization chamber becomes independent of air currents—up to a certain limit. Suitable radioactive elements are, for example, tritium which has a radiation range of only about 1 cm; certain alpha radiation sources such as americium 241 can also be used, in which the radiation range is controlled by suitable shields.

Bipolar and unipolar ionization chambers can be combined in a single structural unit so that a compact element results, the alarm then being triggered by conducting the output signals to an OR-gate, as shown in copending application Ser. No. 666,645, filed Mar. 15, 1976, by the inventor hereof, now U.S. Pat. No. 4,058,803 assigned to the assignee of the present application.

Figure 5:
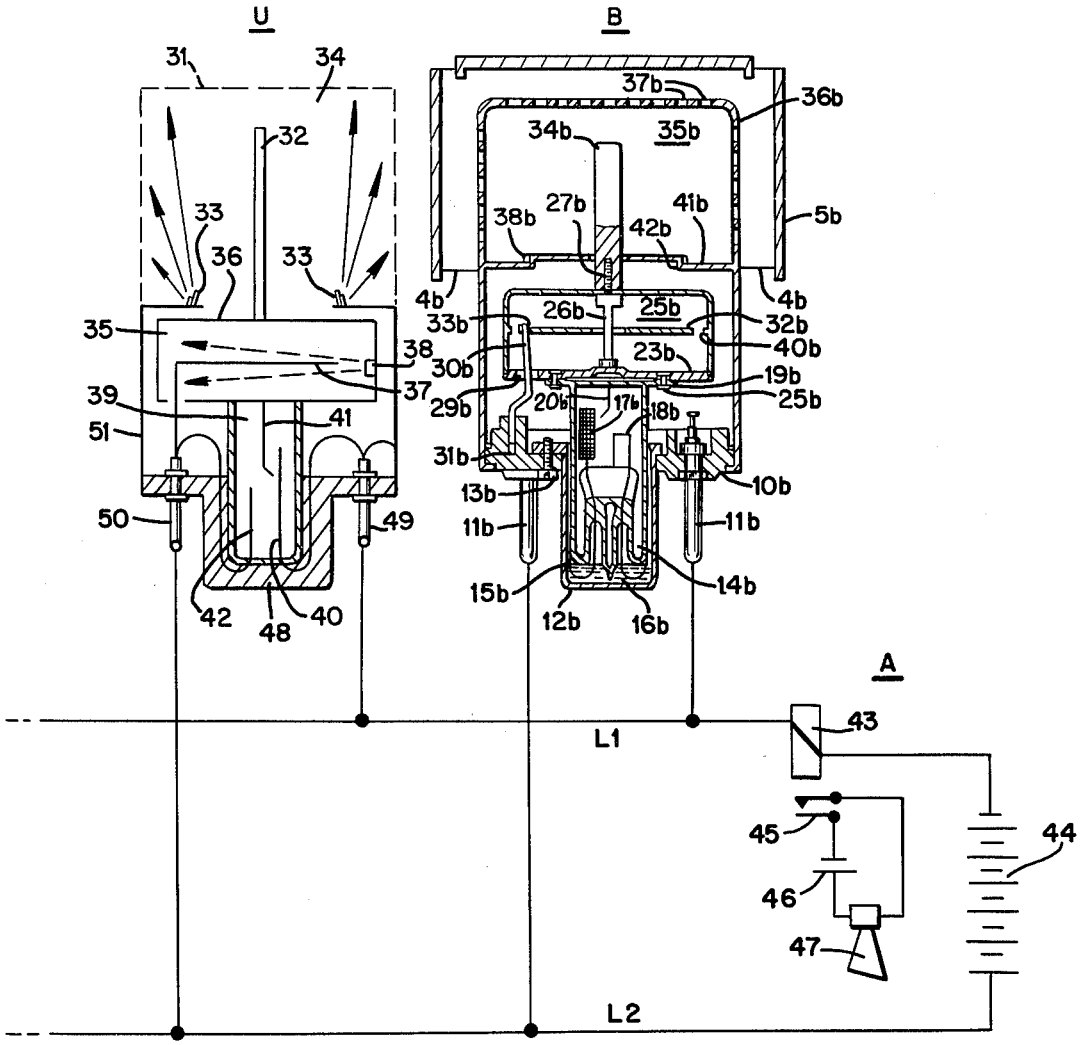
FIG. 5 is a detailed diagram of the system of FIG. 4.

FIG. 5 shows the details of two sensors U and B, in which sensor U is identical to the construction shown in FIG. 8 of cross-referenced U.S. Pat. No. 2,994,768, Derfler; and sensor B is identical to FIG. 2 of cross-referenced U.S. Pat. No. 2,963,600, Meili et al. The alarm system A is identical to that shown in FIG. 7 of the aforementioned Derfler U.S. Pat. No. 2,994,768.

The sensor U has a measuring chamber 34 which consists of electrodes 31 and 32 and a radiation source 33, arranged as follows: The electrode 31 is a jacket-type electrode which is permeable for aerosols. It may, by way of example, be designed as a fine-mesh screen or it may be provided with perforations. The counter electrode is designed as a centrally positioned rod 32. Attached to the electrode 31 are shield means in the form of a ring 33, the outside of which is covered with a radioactive substance so that the portion of, for example, the $\alpha$ radition effective in respect of ionization can become operative only in a portion of the space between the electrodes. This space portion is in the vicinity of the electrode 31.

It is advantageous to employ a cold three-electrode or gas-filled discharge tube as the indicator member, the control circuit being connected in parallel with the measuring chamber.

The measuring chamber 34 consists of the electrodes 31 and 32 and the radiation source 33. The chamber 34 is connected in series with a comparator chamber 35, operating in saturation, the latter comprising the cathodes 36, the anode 37 and the radiation source 38. Arranged parallel with these two ionization chambers is the ionical relay or cold cathode tube 39 with a cathode 40, a control electrode 41 and an anode 42. The arrangement is connected via the coil of relay 43 to the voltage source 44. The contact 45 of the relay 43 is arranged in the circuit of an alarm system consisting of a battery 46 and a horn 47. If combustion gases enter the ionization chamber 34, the voltage of the control electrode 41 will rise and ignite the cold cathode tube 39. A strong current will then flow through the coil of relay 43 so that the alarm circuit is closed through contact 45.

The structural design of the arrangement is also shown. Attached to a base 48 is a housing 51 which encloses the ionization chamber 35. Attached to said base is the cold cathode tube 39 which carries the ionization chamber 35 on the portion projecting from the base 48. The control electrode 41 is arranged on the wall of the ionization chamber 35 facing the cold cathode tube 39 and it projects into the interior of the cold cathode tube 39 as shown. A contact pin 49 is connected to the cathode 40 and the housing 51 and a contact pin 50 with the anode 42 and the electrode 37 of the ionization chamber 35. The electrode 37 is thus placed in the interior of the chamber 35.

The ionization chamber 34 has the outer electrode 31 designed as a perforated cap which may be attached to the housing 51. The electrode 32 of chamber 34 projects from the outer wall of chamber 35. The radioactive substance 33 is arranged as described.

The chamber B comprises a base **10*b* in which, by way of example, two to four contact pins 11*b* are arranged. Downwardly projecting from the base is a metal cup 12*b* which may be provided with a projection (not shown) so that the proper correlation of the contacts is ensured when the unit is inserted in a counter base. The cup 12*b* may be attached to the base 10*b* by means of screws 13*b*. Provided inside the cup 12*b* is a cold cathode tube 14*b* of which the tubular glass 15*b* may be attached inside by means of a layer of putty 16*b*. The cold cathode tube as usual comprises a cathode 17*b* and anode 18*b* and a control electrode 20*b*. The glass body 15*b* extends beyond the edge of the cup 12*b* and is closed, in the embodiment shown, by a metal disk 19*b***. The arrangement of the tube in the metal cup attached to the base entails the following advantages: Firstly, it enables the critically important insulation of the projecting glass body to be measured; secondly, the tube can readily be replaced complete with a cup and, third, the cup can be connected for operation to a suitable potential.

The connections for the cathode **17*b* and the anode 18*b* are shown to be passed out of the tube on the underside and connected to the connecting terminals 11*b*** via leads embedded in the putty.

The disk **19*b*** is formed of a special alloy adapted to the glass so that it can be fused to the glass directly.

Arranged on the metallic disk **19*b* is the lower boundary 23*b* of the ionization chamber 24*b*. The lower boundary 23*b* may, by way of example, be connected to the disk 19*b* by means of the three rivets 25*b***.

The lower boundary plate **23*b* of the ionization chamber 24*b* carries a pin 26*b* which ends in a thread 27*b* resting on a shoulder provided below the thread 27*b* is the cup-shaped upper housing member 28*b* of the ionization chamber 24*b* which engages the outer edge of the closing plate 23*b*. Bores 29*b* are further provided in this plate through which pins 30*b* extend (only one pin visible in FIG. 5) which are embedded in the base 10*b* by means of putty at 31*b***.

The pins **30*b* support the second electrode 32*b* of the ionization chamber 24*b*. Preferably, bores 33*b* are provided in the electrode 32*b* which have a diameter larger than the pins 30*b*. The edges of the bores 33*b* facing outwards are engaged by slots provided in the upper ends of the pins 30*b* so that the latter will hold the electrode 32*b* when appropriately mechanically pretensioned towards the outside. The radioactive preparation for the obtention of ionization in this chamber is preferably arranged at the lateral walls in the drawing, as, e.g., indicated at 40*b*. The counterpart of screw 27*b* is formed by a pin 34*b* which holds the housing 28*b* on the one hand and serves as the electrode for the upper ionization chamber 35*b* on the other. Chamber 35*b* corresponds to chamber 4 of the circuit diagram of FIG. 1 of the cross-referenced U.S. Pat. No. 2,963,600, that is, a chamber which is provided with perforations so that the air can enter. The outer electrode of the ionization chamber 35***b* is formed by the jacket 36*b* enclosing the entire unit which rests on the base 10*b* and is attached thereto. The jacket 36 is provided with a number of perforations 37*b* through which the outer air can enter chamber 35*b*. The radioactive preparation for chamber 35 may be arranged on an intermediate wall 41*b* forming the lower boundary of the said chamber, as diagrammatically indicated at 38*b*. The arrangement is preferably designed so that the preparation 38*b* is attached to a shoulder 42*b* of wall 41*b*; the ionizing particles will thus travel mainly into the outer periphery of the chamber 35*b* as shown.

The ionization chambers 24*b* and 35*b* are so dimensioned that, when the composition of the air is normal, the potential at the center point between the chambers will not suffice to ignite the cold cathode tube. However, if smoke particles enter the chamber 35*b* through the perforations, the current flowing through this chamber will be reduced since the substantially larger smoke particles will, on being ionized by the radium preparation, move through the correspondingly dimensioned electric field more slowly than ionized air particles. This causes the potential at the center point to be raised so that the cold cathode tube is ignited. This, in turn, causes the relay 43*b* to pull in and, by way of example, to operate the fire alarm.

The sensors U, B are preferably located on the ceiling of the space to be supervised. As described in cross-referenced U.S. Pat. No. 3,710,110, Lampart et al, the peripheral portions of the base or socket are constructed to partake the form of a truncated cone so that smoke containing air flowing directly along the ceiling is led into openings or apertures 4*b* of housing portion 5*b*, and secured to the housing jacket 36*b*.

Various changes and modifications may be made within the scope of the inventive concept.

I claim:

1. Fire sensing system to supervise a predetermined space for the presence of fire or smoke therein having an alarm unit (A) responsive to electrical signals to provide an alarm signal, and at least two sensors (U, B) each providing an electrical output signal connected to the alarm unit to cause the alarm unit to provide an alarm output signal when at least one of the sensors responds wherein, in accordance with the invention, both said sensors are ionization-type sensors, both said sensors (U, B) are located in said space to be supervised, and both said sensors are responsive to possible presence of smoke aerosols due to a fire in said space;

and wherein one of the sensors (B) is a bipolar ionization-type smoke and fire aerosol sensor having a shielded sensing ion chamber exposed to the atmosphere in said space and including baffle means (b, 5*b*) thereon formed to slow atmospheric current thereto, said first, bipolar sensor (B) providing a discrete output signal upon penetration of smoke aerosols through said baffle means (b, 5*b*) to the shielded sensing ion chamber;

and the second sensor (U) is an essentially unipolar ionization-type smoke and fire aerosol sensor having a sensing ion chamber exposed to the atmosphere in said space and essentially freely accessible to air currents flowing through the sensing ion chamber of the sensor, said second, unipolar sensor (U) providing a discrete output signal upon detection of smoke or fire aerosols in the atmosphere to which it is exposed if the air currents through the ion chamber are of low velocity;

and common connection means (L1, L2) connected to both said sensors and to the alarm unit (A) to provide the alarm signal when either of said sensors provides a respective discrete output signal upon the presence of smoke or fire aerosol in said supervised space.

2. System according to claim 1, further comprising an additional fire sensor located in said space responding to characteristics of fire other than the response characteristics of both said sensors (U, B) and additionally connected to said alarm unit (A).

3. System according to claim 1, wherein the bipolar ionization chamber (B) comprises two electrodes and a radiation source located with respect to the electrodes to effectively ionize the entire space between the electrodes;

and wherein the unipolar chamber comprises two electrodes and a radiation source, the radiation source being located with respect to the two electrodes to ionize only a portion of the space between the electrodes.

4. System according to claim 5, wherein the portion of the space of the unipolar chamber which is ionized forms a minor portion of the space between the electrodes.

5. System according to claim 5, wherein the major portion of the space between the electrodes of the unipolar sensor has a unipolar space charge therein.

6. System according to claim 1, wherein both sensors (U,B) are connected in parallel between the common connecting lines (L1, L2).

* * * * *